US009593907B2

(12) United States Patent
Regan et al.

(10) Patent No.: US 9,593,907 B2
(45) Date of Patent: Mar. 14, 2017

(54) MICRO-PIXELATED LED RETICLE DISPLAY FOR OPTICAL AIMING DEVICES

(71) Applicant: Leupold & Stevens, Inc., Beaverton, OR (US)

(72) Inventors: Rick R. Regan, Aloha, OR (US); Victoria J. Peters, Beaverton, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 313 days.

(21) Appl. No.: 14/576,038

(22) Filed: Dec. 18, 2014

(65) Prior Publication Data

US 2016/0231083 A1 Aug. 11, 2016

Related U.S. Application Data

(60) Provisional application No. 61/917,907, filed on Dec. 18, 2013.

(51) Int. Cl.

| | |
|---|---|
| ***G06G 7/80*** | (2006.01) |
| ***F41G 1/00*** | (2006.01) |
| ***F41G 1/34*** | (2006.01) |
| ***F41G 1/38*** | (2006.01) |
| ***F41G 1/30*** | (2006.01) |
| ***F41G 3/06*** | (2006.01) |

(52) U.S. Cl.

CPC ..... *F41G 1/345* (2013.01); *F41G 1/30* (2013.01); *F41G 1/38* (2013.01); *F41G 3/06* (2013.01)

(58) Field of Classification Search

USPC ..... 235/404; 42/130, 131

See application file for complete search history.

(56) References Cited

U.S. PATENT DOCUMENTS

| | | | |
|---|---|---|---|
| 5,941,215 | A | 8/1999 | Augustin |
| 8,557,616 | B2 | 10/2013 | Lau et al. |
| 8,642,363 | B2 | 2/2014 | Lau et al. |
| 9,034,754 | B2 | 5/2015 | Golda et al. |
| 9,041,025 | B2 | 5/2015 | Lau et al. |
| 2005/0252062 | A1 | 11/2005 | Scrogin et al. |
| 2006/0162226 | A1 | 7/2006 | Tai |
| 2009/0188976 | A1 | 7/2009 | Gunnarsson et al. |
| 2011/0296733 | A1 | 12/2011 | York |
| 2012/0126255 | A1 | 5/2012 | Hussell et al. |
| 2012/0159833 | A1 | 6/2012 | Hakanson et al. |
| 2015/0137153 | A1 | 5/2015 | Bibl et al. |

OTHER PUBLICATIONS

Korean Intellectual Property Office, International Search Report and Written Opinion, International Patent Application No. PCT/US2014/071313, dated Apr. 8, 2015, 15 pp.

*Primary Examiner* — Daniel Hess

(74) *Attorney, Agent, or Firm* — Stoel Rives LLP

(57) ABSTRACT

A sighting device, such as a riflescope, a reflex sight, or a spotting scope, having a display device including an addressable, emissive collection of micro display elements for generating a finely pixelated, high-resolution aiming mark. The sighting device includes a controller coupled to the display device to selectively power one or more of the display elements to generate the aiming mark. The micro display elements may be inorganic light-emitting diodes (LEDs) having a pixel size of 25 μm or less, and the display elements may be arranged at a pixel pitch of 30 μm or less.

16 Claims, 8 Drawing Sheets

MICRO-PIXELATED LED RETICLE DISPLAY FOR OPTICAL AIMING DEVICES

RELATED APPLICATION DATA

This application is a nonprovisional of and claims the benefit under 35 U.S.C. §119(e) of U.S. Provisional Patent Application No. 61/917,907, filed Dec. 18, 2013, the disclosure of which is incorporated by reference herein in its entirety.

TECHNICAL FIELD

The field of the present disclosure relates generally to riflescopes, reflex sights, and other aimed optical sighting devices and aiming devices. In particular, the field of the disclosure relates to reticle systems for such devices that include finely pixelated LED displays.

BACKGROUND

Optical sighting devices such as riflescopes are often used to aid the aiming of light weapons, such as rifles, pistols, bows, or the like. Such optical sighting devices typically include reticles, which may take various forms, such as cross-hairs, posts, circles, horseshoes, a dot, or other suitable shapes, to help a shooter aim at the target. In addition to riflescopes, reticles are also sometimes included in binoculars, spotting scopes and other optical sighting devices, particularly such devices used by a spotter of a spotter-shooter team to assist a shooter in aiming a weapon using a separate riflescope. Some reticles include various marks, such as optical range finding marks to facilitate estimating a distance to a target of known size, holdover aiming marks for adjusting for the ballistic drop of a projectile for targets located at various ranges from the shooter, and various other marks to assist the shooter in acquiring information, or adjusting for variables relating to weapon inclination, cross-winds, or other shooting conditions.

In conventional optical sighting devices, the reticle is seen by the shooter in silhouette or superimposed over the target image. In some earlier optical sighting devices, engraved/etched lines or embedded fibers were used to create the superimposed reticle patterns (e.g., crosshairs) on the viewed target. Presently, many modern optical sighting devices utilize illuminated displays that provide an illuminated reticle pattern in the optical axis or project the reticle pattern toward an optical element that then redirects the image toward the viewer's eye so that the reticle appears superimposed on the target image when viewed by the user.

The present inventors have identified disadvantages with many modern optical sighting devices. For example, one such disadvantage is that such prior art systems tend to have one or a limited number of reticle patterns defined by collections of a relatively small number of special-purpose display segments. Another disadvantage of such systems is that many use illumination devices (such as LEDs) that produce low-resolution reticles and/or produce visual artifacts that may distract the user. The present inventors have therefore identified a need for an improved optical sighting device capable of providing a relatively large variety of illuminated reticle patterns and aiming features with enhanced brightness, clarity, and resolution. Additional aspects and advantages will be apparent from the following detailed description of preferred embodiments, which proceeds with reference to the accompanying drawings.

DETAILED DESCRIPTION OF PREFERRED EMBODIMENTS

With reference to the drawings, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

For convenience, the following discussion references riflescopes as a prototypical direct view optical aiming device. However, the following details and descriptions may be applied to other suitable optical sighting devices. Generally, a direct view aiming device includes optical components, such as one or more lenses, and prisms, and may also include digital displays/systems, that collectively operate to enhance the human eye and may include pistol scopes, spotting scopes, rangefinders, bow sights, or other riflescopes that differ from those specifically discussed herein.

FIGS. 1-10 collectively illustrate various embodiments and details of a riflescope 5 and a reflex sight 90, 92 (FIGS. 2 and 3) having a reticle system with a finely pixelated light-emitting diode (LED) display. As is described in further detail below, the reticle system may include one or more controllers for selectively powering each of the LED elements to generate various reticle patterns. The reticle system may also be programmable to provide the riflescope 5 and/or reflex sights 90, 92, with the flexibility to display any one of a wide variety of distinct reticle patterns for viewing by the user. Additional details of these and other embodiments are described in detail below with reference to the accompanying figures.

Figure 1:
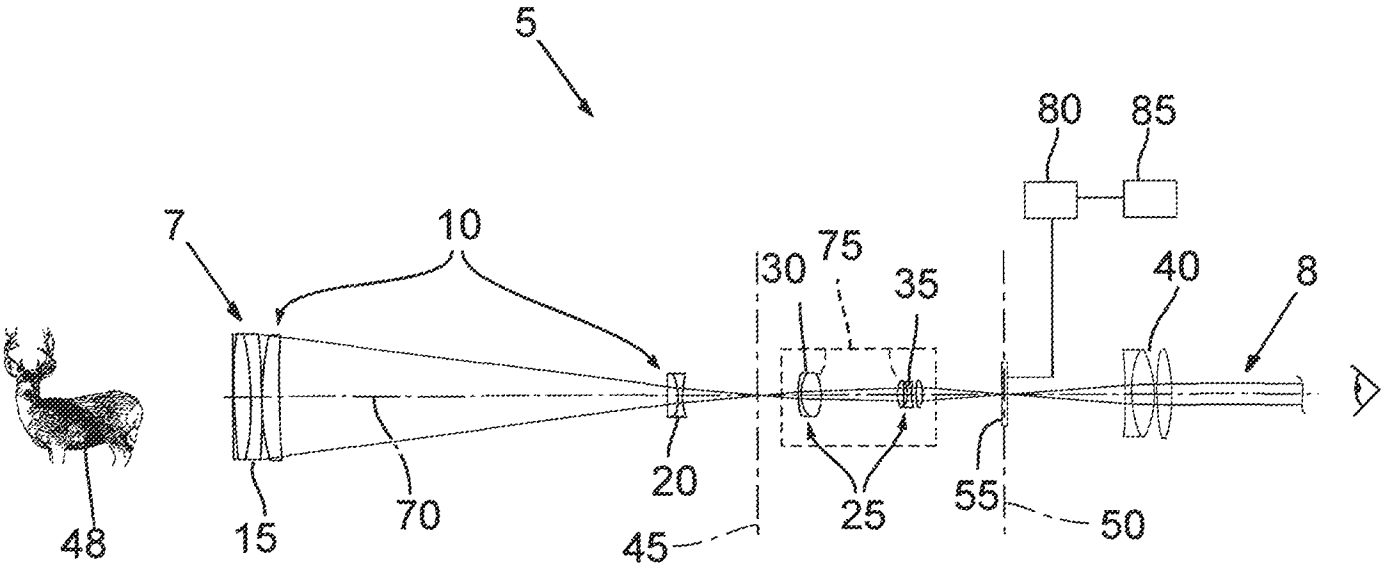
FIG. 1 is a side schematic view of a riflescope according to one embodiment.

FIG. 1 illustrates an example embodiment of a riflescope 5 according to one embodiment of a direct view aiming device. With reference to FIG. 1, the riflescope 5 includes a typically elongated and tubular housing (not shown) supporting an objective 10 adjacent a target-facing end of the housing, an eyepiece 40 adjacent a viewing end 8 of the housing, and an erector assembly 25 positioned therebetween. The objective 10 may include a primary objective lens system 15 and a field lens 20 to aid in gathering and directing light to a front focal plane 45 of the riflescope 5, whereat the objective 10 produces an image of a distant object or target 48. At the front focal plane 45, the image is inverted, i.e., the image is upside down and switched left from right. The erector assembly 25 is located behind the front focal plane 45 and is operable to reorient the image of the object 48 by producing an erect image thereof at the rear focal plane 50 behind the erector assembly 25, so that the top and bottom of the image at the rear focal plane 50 corresponds to the top and bottom of the actual target as normally perceived with the naked eye. The erector assembly 25 typically includes a mechanical, electro-mechanical, or electro-optical system to drive cooperative movement of both a focus lens 30 and one or more power-varying lens elements of a magnification lens 35 to provide a continuously variable magnification range throughout which the erector assembly 25 produces a focused, erect image of the distant target at the rear focal plane 50.

In some embodiments, the riflescope 5 may further include an optical magnification adjustment mechanism 75 operatively connected to the erector assembly 25 for manipulating or adjusting the optical magnification (colloquially referred to as optical zoom or optical power) of the riflescope 5. The magnification adjustment mechanism 75 may be mechanical in nature and hand operated, or may include motor driven zoom selectors, electro-mechanical zoom selectors or electro-optical zoom selectors. Additional details and example embodiments of such a riflescope 5 may be found in Patent Application No. US 2013/0033746 A1, the disclosure of which is incorporated herein by reference in its entirety.

The riflescope 5 also includes a reticle 55, which may be located proximate or at the rear focal plane 50, or alternatively proximate or at the front focal plane 45. The reticle 55 may include a transparent electronic reticle display comprising an LED array for producing any one of a number of reticle patterns (for example, reticle pattern 225 described with particular reference to FIGS. 5-8, or reticle patterns 160, 165, 170 described with reference to FIG. 3) into the viewer's line of sight so that the reticle pattern appears superimposed on the target 48 when viewed by the user. In some embodiments, the reticle 55 and LED array may be in communication with a controller 80, such as via a communication cable 86 (see FIG. 5), operable to deliver power to distinct combinations of the LED elements in the LED array to create a wide variety of reticle patterns. Further details and example embodiments of the LED array and LED configurations operable to produce various reticle patterns are discussed in detail below with reference to FIGS. 3-10.

Figure 2:
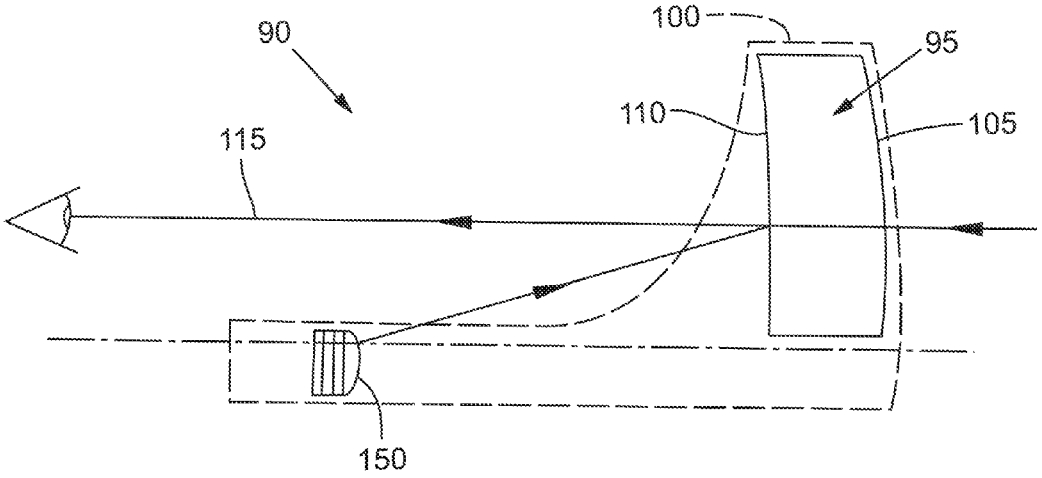
FIG. 2 is a side schematic view of an example configuration of a reflex sight according to one embodiment.

FIG. 2 illustrates an example embodiment of a reflex sight 90 according to another embodiment of a direct view aiming device. Generally, a reflex sight is an optical device that allows the user to look through a partially reflecting glass element and see an illuminated projection of an aiming point or reticle pattern superimposed on the unmagnified field of view or the user's line of sight. Since reflex sights and their construction/operation are generally known in the art, the following section focuses on certain components of the reflex sight 90.

With reference to FIG. 2, the reflex sight 90 includes an optical element 95 mounted in a generally upright position in a housing 100 (illustrated in dashed lines). The optical element 95 has a front surface 105 (which faces the target 48) and a rear surface 110 (which faces the user) at least one of which reflects light of a predetermined narrow range of wavelengths. The reflex sight 90 further includes an LED array (e.g., LED array 150 of FIG. 3) which is preferably comprised of a number of inorganic LED elements (e.g., LED elements 155). The LED array 150 is positioned on a plane on the optical axis of the optical element 95 and below the line of sight 115 so as to avoid directly interfering with the line of sight 115. As further described in detail below, combinations or subsets of the LED elements 155 of the LED array 150 may be powered (such as by the controller 80) to create a desired one of various reticle patterns (e.g., 160, 165, 170, 185, 225). The illuminated reticle pattern is collimated by the reflective surface of the optical element 95 and reflected back into the user's eye so when the user views the target through the reflex sight 90, the user sees the reticle pattern superimposed on the target. Additional details and example embodiments of such a reflex sight 90 may be found in U.S. Pat. No. 6,327,806, the disclosure of which is incorporated herein by reference.

Figure 2A:
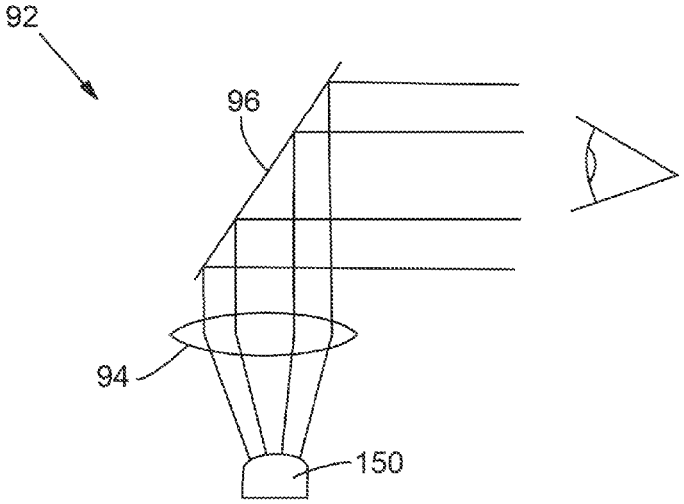
FIG. 2A is a side schematic view of another embodiment of a reflex sight.

FIG. 2A illustrates a reflex sight 92 according to yet another embodiment. With reference to FIG. 2A, the reflex sight 92 includes a collimating lens 94 and a planar beam splitter 96, and also includes an LED array (such as LED array 150) positioned below the collimating lens 94 and beam splitter 96. The illuminated reticle pattern produced by the. LED array is collimated by the collimating lens 94 and reflected back into the user's eye by the beam splitter 96 so when the user views the target through the reflex sight 92, the user sees the reticle pattern superimposed on the target. It should be understood that reflex sights 90, 92 illustrate two example embodiments of a reflex sight. In other embodiments, the optical elements and components of the reflex sights may be arranged in a different configuration.

Figure 3:
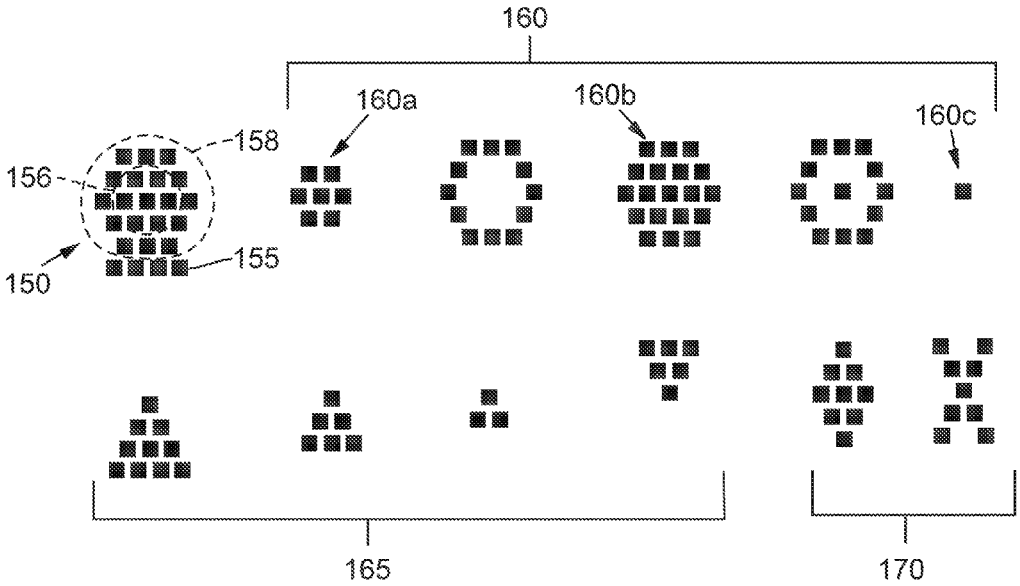
FIG. 3 is a schematic view of an LED array with individually addressable LED elements for forming various reticle patterns.

FIG. 3 illustrates a two-dimensional LED array 150 having a plurality of LED elements 155, and a variety of reticle patterns 160, 165, 170 that may be formed by selectively powering various combinations/subsets of the LED elements 155. As is further described in detail below, in an example operation, the controller 80 receives information (such as ranging information, shooting conditions, etc.) from a user (via a keypad or other input device) and/or from a laser rangefinder 85 (see FIG. 1) or other aiming data source to determine which reticle pattern to generate from the LED array 150. It should be understood that the rangefinder 85 may be integrated with the aiming device or may be a separate device (e.g., separate from the riflescope 5) that is in communication with the controller 80. Additional details and example embodiments of such a rangefinder 85 may be found in U.S. Pat. No. 7,654,029, the disclosure of which is incorporated by reference herein. Once the desired reticle pattern is determined, the controller 80 selectively powers one or more of the LED elements 155 to generate the selected reticle pattern. In such a configuration, the LED array 150 and the LED elements 155 provide the aiming device with flexibility to display a wide variety of distinct reticle patterns for viewing by the user.

As described previously, the LED array 150 may be used in conjunction with either the riflescope 5 or the reflex sight 90 to produce the reticle patterns. However, as will be appreciated by those having skill in the art, the simplicity of the reticle patterns 160, 165, 170 illustrated in FIG. 3 may be better suited for use with the reflex sight 90, whereas the reticle patterns with various aiming points, holdover adjustments, and other details (such as reticle pattern 225 illustrated in FIGS. 5-8 and described in detail with reference to those figures) may be better suited for use with riflescope 5 and spotting scopes. The following section proceeds with a detailed description of the LED array 150 and its components.

With reference to FIG. 3, the LED array 150 includes a number of LED elements 155 that are each separately addressable and may be individually powered to create various reticle patterns, such as reticle patterns 160, 165, 170. In one example arrangement, the LED array 150 may include LED elements 155 linearly arranged in six rows. The LED elements 55 may be offset between each of the rows so that the LED elements 155 in the odd numbered rows (e.g., first row, third row, etc.) are aligned with one another and the LED elements 155 in the even numbered rows (e.g., second row, fourth row, etc.) are aligned with each other. In some embodiments, offsetting the LED elements 155 may help produce sharper, more focused edges for the reticle patterns 160, 165, 170 when the LED elements 155 are illuminated.

The LED array 150 is a micro-pixelated LED array and the LED elements 155 are micro-pixelated LEDs (also referred to as micro-LEDs or μLEDs in the description) having a small pixel size generally less than 75 μm. In some embodiments, the LED elements 155 may each have a pixel size ranging from approximately 8 μm to approximately 25 μm, and have a pixel pitch (both vertically and horizontally on the micro-LED array 150) ranging from approximately 10 μm to approximately 30 μm. In one embodiment, the micro-LED elements 155 have a uniform pixel size of approximately 14 μm (e.g., all micro-LED elements 155 are the same size within a small tolerance) and are arranged in the micro-LED array 150 with a uniform pixel pitch of approximately 25 μm. In some embodiments, the LED elements 155 may each have a pixel size of 25 μm or less and a pixel pitch of approximately 30 μm or less.

For comparison purposes, conventional LED pixel sizes are typically on the order of 200-300 μm in diameter or larger. It should be understood that the ranges and example embodiments for the pixel size and pixel pitch of the micro-LED elements are given for illustration purposes only and are not intended to be limiting. For instance, in other embodiments, the pixel size of the LED elements 155 may be smaller than 8 μm or larger than 20 μm, and the LED elements 155 may be arranged on the micro-LED array 150 with a pixel pitch of less than 15 μm or more than 30 μm.

In some embodiments, the micro-LEDs 155 may be inorganic and based on gallium nitride light emitting diodes (GaN LEDs). The micro-LED arrays 150 (comprising numerous μLEDs arranged in a grid or other array) may provide a high-density, emissive micro-display that is not based on external switching or filtering systems. As mentioned previously, the micro-LEDs 155 may have a pixel size of less than 20 μm, or may range from between 8-20 μm. Because of their small size, the individual micro-LEDs 155 may emit light at high optical power densities and can be switched at very high speeds. For instance, in some embodiments, the micro-LEDs 155 may have an optical power density greater than 2000 mw/mm$^2$ and can be switched at speeds of less than 500 picoseconds. In addition, the micro-LED arrays 150 may provide other advantages/benefits, such as a small footprint, minimal heating, and high current density handling (e.g., up to approximately 4000 A/cm$^2$). The high optical power density and extremely fast switching speeds of the micro-LEDs 155 provide for a micro-LED array 150 capable of producing bright and sharp features for the reticle patterns (e.g., 160, 165, 170, 185, 225) as is further described in detail below.

In some embodiments, the GaN-based, micro-LED array 150 may be grown on, bonded on, or otherwise formed on a transparent sapphire substrate. Preferably, the sapphire substrate is textured, etched, or otherwise patterned to increase the internal quantum efficiency and light extraction efficiency (i.e., to extract more light from the surface of the micro-LEDs 155) of the micro-LEDs 155. In other embodiments, silver nanoparticles may be deposited/dispersed on the patterned sapphire substrate to coat the substrate prior to bonding the micro-LEDs to further improve the light efficiency and output power of the GaN-based micro-LEDs 155 and of the micro-LED array 150.

In some embodiments, the micro-LEDs 155 may be indium gallium nitride (InGaN) LEDs that may be integrated with complementary metal-oxide semiconductor (CMOS) electronics for tuning/changing the output color of individual or groups of micro-LEDs 155 as desired (and by extension, the color of the reticle patterns viewed by the user). For instance, in one embodiment, each μLED element (or pixel) in the micro-LED array 150 is electrically connected to a respective CMOS driver that includes logic and circuitry for controlling the μLED element. When the CMOS driver receives an input trigger signal, the CMOS driver is turned on and controls the output (e.g., the color and intensity) of the corresponding μLED element. The color output of each individual μLED element may be changed (e.g., from red to blue) by altering the current density supplied to it. In this configuration, the riflescope 5 and/or reflex sight 90 may be capable of displaying reticle patterns (e.g., 160, 165, 170, 185, 225 described below with reference to FIGS. 3-8) in various colors, which may help provide different options to aid the user in aiming at a target for a variety of shooting conditions.

In some embodiments, the user may be able to change a reticle pattern from red to blue, for instance, by actuating a switch or button, selecting an option on an electronic menu, or otherwise providing input to the controller 80 which may be in communication with the CMOS driver. In other embodiments, the controller 80 (or other system) may drive the color of the reticle pattern based on any of a number of variables, such as: ranging information received from the laser rangefinder 85 (e.g., the reticle pattern may be red at long range and blue at short range), and lighting conditions (e.g., the reticle pattern may be green in lower ambient light settings, and blue in higher ambient light settings).

As briefly described previously, particular combinations/subsets of LED elements 155 in the LED array 150 may be illuminated individually or as a group to produce a variety of reticle patterns 160, 165, 170. If all the LED elements 155 are illuminated, the entire LED array 150 would appear as the reticle pattern that is viewable by the user. In many instances, however, the desired reticle pattern 160, 165, 170 is created using a subset of the LED elements 155 in the LED array 150.

For example, a circular reticle pattern 160*a* may be produced by illuminating all the LED elements 155 contained within a first subset 156 of the LED array 150. With reference to FIG. 3, the first subset 156 may comprise the middle two LED elements 155 from the second and fourth rows and the three middle elements 155 from the third row of the LED array 150. The micro-scaled pixel size and pixel pitch of the LED elements 155 yield a bright, high-resolution round reticle pattern 160*a* that is superimposed on the target image when viewed by the user. Similarly, in another example, the circular reticle pattern could be made larger by illuminating a second subset 158 of LED elements 155 which may be different than and/or include the first subset 156 of LED elements 155. For instance, reticle pattern 160*c* may include all the LED elements 155 in the first five rows of the LED array 150 (including the LED elements 155 contained within the first subset 156). While the first and second subsets 156, 158 may be different from one another in some embodiments, it should be understood that the first and second subsets 156, 158 of LED elements 155 may or may not be mutually exclusive in other embodiments.

As illustrated in FIG. 3, the LED elements 155 may be powered in various combinations to create a wide variety of reticle patterns 160, including a reticle pattern 160*c* made by powering a single, central LED element 155 in the LED array 150 to produce a reticle pattern with a single aiming point such as is used in a typical red-dot sight. It should be understood that the circular reticle patterns 160 are for illustration purposes and not considered to be limiting. In other examples, other combinations of the LED elements 155 may be illuminated to produce reticle patterns having other shapes, such as the triangular shapes illustrated in reticle patterns 165 or other miscellaneous shapes illustrated in reticle patterns 170. In still other embodiments, the LED array 150 may be constructed with any number and arrangement of LED elements 155 to produce numerous reticle pattern variations that are not specifically described.

In some instances, the shape and size of the reticle patterns that can be produced may be limited by the arrangement of the LED elements in the LED array. For instance, with particular reference to the LED array 150 illustrated in FIG. 3, because the LED elements 155 are offset between adjacent rows, the LED array 150 may have some difficulty producing high-resolution reticle patterns with vertical lines, such as may be used in a "plus-sign" style reticle. However, in another LED array (such as the embodiment shown in FIG. 4) a high-resolution "plus-sign" reticle pattern can be more easily produced when the LED elements are aligned in rows and columns.

In some embodiments, the reticle patterns 160, 165, 170 may be selected from one or more reticle patterns that are stored in a memory. In other words, the controller 80 or other system may determine which LED elements 155 to illuminate based on a stored reticle pattern. In another embodiment, the reticle patterns 160, 165, 170 may not be stored in memory, but may instead be calculated as further described below with reference to FIG. 4.

Figure 4:
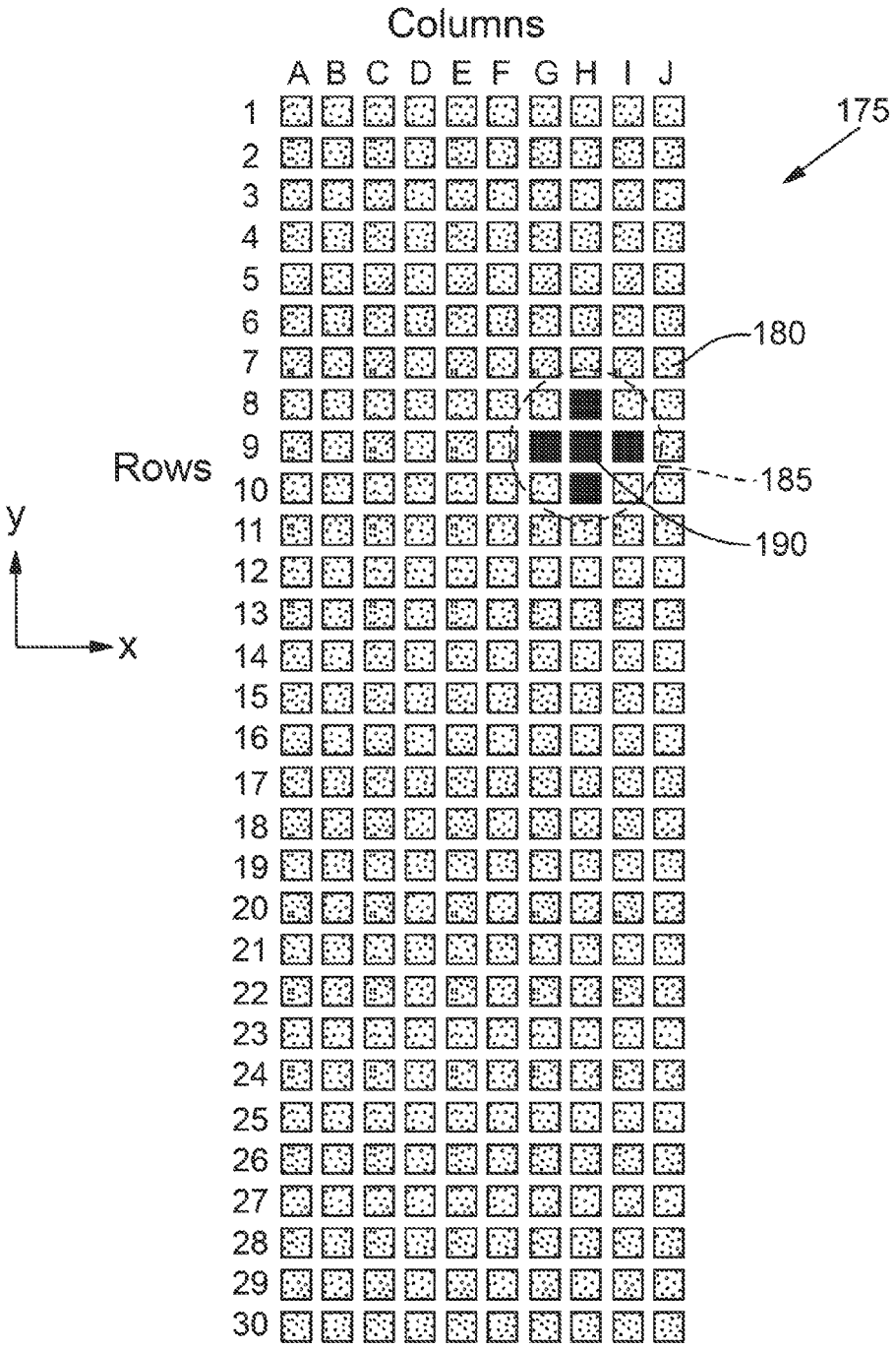
FIG. 4 is a schematic view of an LED array with individually addressable LED elements that can be selectively powered to form a desired reticle pattern, according to another embodiment.

FIG. 4 illustrates an example embodiment of an LED grid array 175 having a plurality of individually addressable LED elements 180 arranged in rows similar to the LED array 150 of FIG. 2. The rows of LED elements 180 may be aligned with respect to one another, or may be offset as described with reference to the LED array 150 of FIG. 2. The following section describes an example process for calculating and producing a reticle pattern 185 using firmware that may be run by controller 80.

With reference to FIG. 4, a micro-LED element 190 positioned at an initial x, y coordinate on the LED grid array 175 is determined or selected. The coordinates for the micro-LED element 190 may be determined based on one or a combination of characteristics, such as target ranging information provided by the laser rangefinder 85 (see FIG. 1), ballistics calculations, user setup, etc. Once the starting coordinates are determined, the controller 80 may run a process defined in software or firmware illuminate nearby LED elements 180 and create a desired reticle pattern. For instance, to create the reticle pattern 185 in the shape of a "plus-sign," the firmware may begin with the x, y coordinate pair of the micro-LED element 190, and illuminate the LED elements 180 located at the following coordinates: (1) x+1, y; (2) x+1, y+1; (3) x−1, y−1; and (4) x, y−1. In other embodiments, the firmware may illuminate other patterns of reticles using a starting coordinate pair and calculating the addresses of other LED elements that should be illuminated to create the desired reticle pattern.

FIGS. 5-8 collectively illustrate details of reticle 55 of FIG. 1 for displaying a reticle pattern 225 and various features thereof. As briefly described previously, the reticle 55 and/or the reticle pattern 225 may alternatively be used with other optical sighting devices, such as binoculars, spotting scopes, rangefinder aiming sights, reflex sight 90, or the like. It should be noted that the reticle pattern 225 of FIGS. 5-8 is illustrated rotated 90° to facilitate dimensioning in FIG. 8. When the reticle pattern 225 of FIGS. 5-8 is viewed by the user through the eyepiece 40 (FIG. 1), the user will see the reticle pattern rotated clockwise 90° relative to the orientation shown in FIGS. 5-8.

Figure 5:
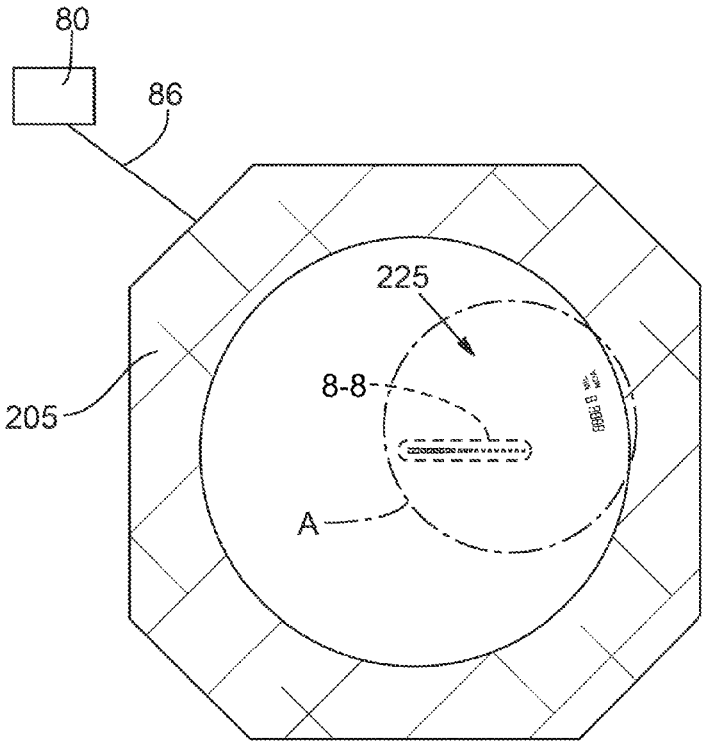
FIG. 5 is a schematic view of a reticle pattern and a package for accommodating connector leads and wires for the LED array of FIGS. 3 and 4.

With reference to FIG. 5, reticle 55 preferably is mounted to a package 205 that may be used to house leads or wires and electronic circuitry for powering and/or controlling the micro-LED elements 200 that create the reticle pattern 225. The package 205 is preferably a solid material, such as such as epoxy or polyurethane, for grouping the wiring together and protecting the wires and LED array from shock, vibration, moisture, or other external variables.

Figure 6:
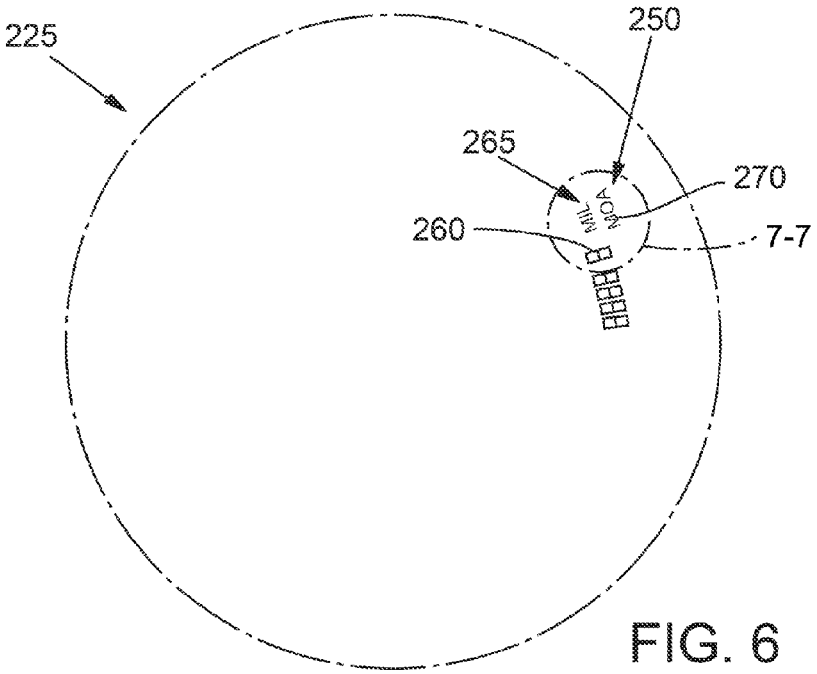
FIG. 6 is an enlarged view illustrating certain details of the reticle pattern of FIG. 5.
Figure 7:
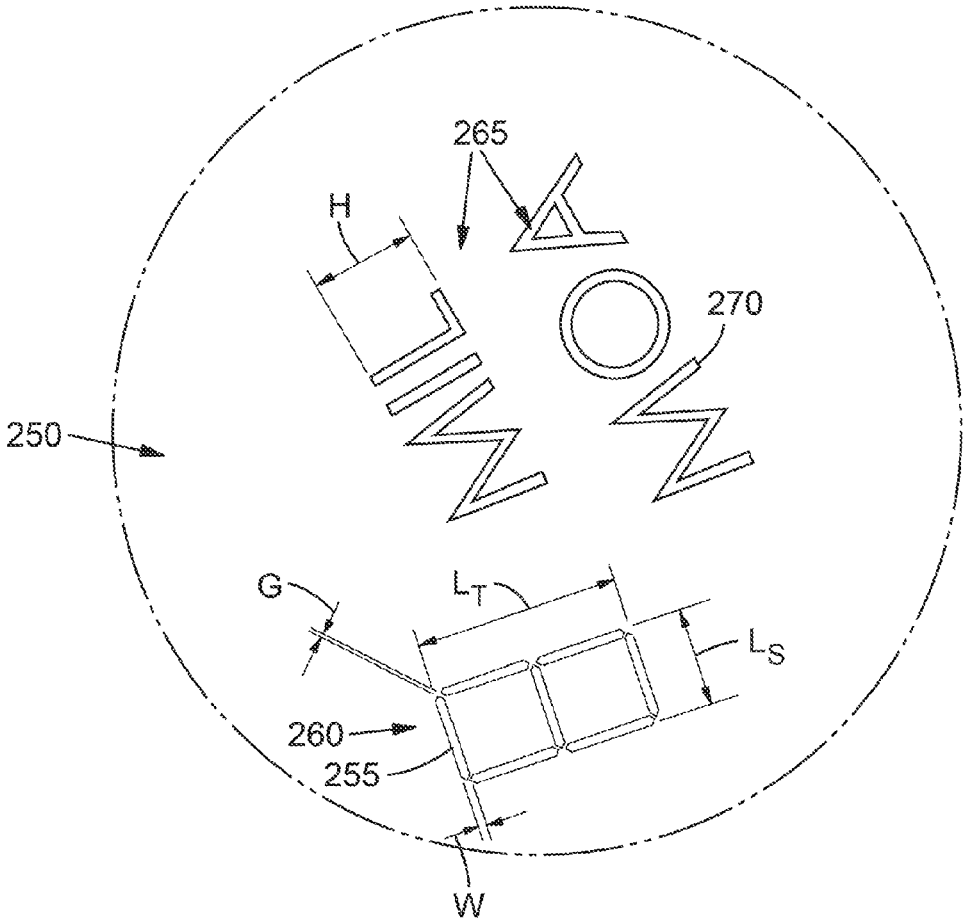
FIG. 7 is an enlarged view of detail 7-7 of the reticle pattern of FIG. 6 illustrating a micro-pixelated display.

FIG. 6 is an enlarged view of a portion of the reticle pattern 225 and FIG. 7 illustrates additional details of a micro-pixelated display 250 noted in detail 7-7 of FIG. 6. The following sections proceed with a description of the features of the reticle pattern 225 and the micro-pixelated display 250 illustrated in FIGS. 6 and 7. With reference to FIGS. 6 and 7, the display 250 may include a numerical display portion 260 comprised of a plurality of leg segments 255 arranged in a series of miniaturized seven-segment display groups, where the leg segments 255 of each seven-segment display group may be individually illuminated in different combinations to generate the digits 0-9. The display 250 may also include a character or symbol display portion 265 comprised of a plurality of character elements 270 having a height H ranging between 10 μm to 25 μm. In other embodiments, the height H may be 20 μm or less. The character elements 270 may be arranged to spell MIL and MOA and may be illuminated to indicate to the user whether the measurements displayed in the numerical display portion 260 are in units of milliradians (MIL) or minutes of angle (MOA).

In one embodiment, each leg segment 225 has a length $L_S$ of approximately 0.17 mm (170 μm) and a width W of approximately 0.014 mm (14 μm). Each leg segment 255 is preferably spaced apart from an adjacent leg segment 255 by a gap G of approximately 0.007 mm (7 μm). As illustrated, the total length $L_T$ of numerical display portion 260 may be approximately 0.35 mm (350 μm) or range from 300 μm to 400 μm. In other embodiments, the leg segment 225 may range in length $L_S$ from between 125 μm to 200 μm, and spaced apart by a gap G ranging from 5 μm to 10 μm.

Figure 8:
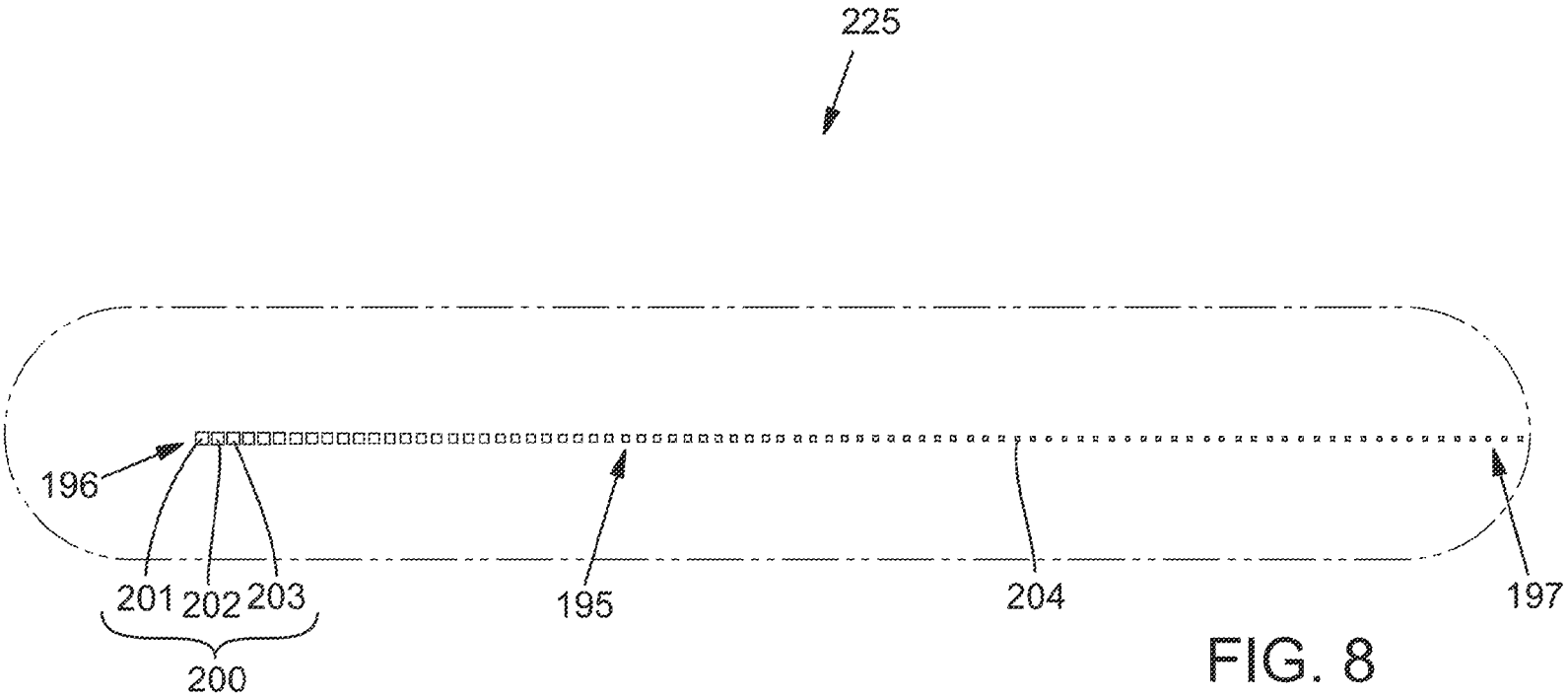
FIG. 8 is an enlarged view of detail 8-8 of the reticle pattern of FIG. 5 illustrating details of the aiming points in the reticle pattern.

FIG. 8 is an enlarged view of detail 8-8 of the reticle pattern 225 of FIG. 5 illustrating details of the aiming points (which represent holdover adjustments) in the reticle pattern 225 that includes a number of LED elements 200 aligned in a vertical column 195 that may be selectively or simultaneously illuminated to create a post pattern. As illustrated in FIG. 8 (and further described in detail below), the LED elements 200 may be larger in size on a top/upper end 196 of the vertical column 195, and the LED elements 200 may diminish in size downwardly from the upper end 196 to create a reticle pattern 225 with aiming points that are smaller in size toward a lower end 197. In such cases, the user will perceive that the reticle pattern 225 covers (that is, overlies or obstructs) different amounts or portions of the distant target (such as target 48 of FIG. 1) depending on the distance to the target (e.g., as the distance to the target increases, the size of the target as viewed by the user diminishes).

For instance, for a target 48 that is 500 yards away from the user, the target 48 appears smaller when viewed (without magnification) through the eyepiece in comparison to a target 48 was 50 yards away, which will appear much larger. As mentioned previously, each aiming point may represent a holdover adjustment for aiding the user in shooting the target 48 at different ranges. As is known in the art, holdover aiming points for longer ranges (e.g., 500 yards) are near the lower end 197 of the reticle pattern 225. Conversely, holdover aiming points for closer ranges (e.g., 50 yards) are near the upper end 196 of the reticle pattern 225. Thus, having larger LED elements 200 at the upper end 196 and smaller LED elements 200 at the lower end 197 creates a reticle pattern 225 with aiming points appropriately sized so as to provide good illumination intensity and visual acquisition speed, without unduly covering or obscuring the target 48 when viewed by the user through the aiming device 5, 90.

With particular reference to FIG. 8, the LED element 201 at the upper end 196 is the largest and the LED elements 200 diminish in size from the upper end 196 toward the lower end 197 of the vertical column 195. For instance, in one embodiment, the uppermost LED element 201 may have a width of approximately 0.040 mm (40 μm), the next LED element 202 may have a width of approximately 0.0395 mm (39.5 μm), and the subsequent LED element 203 may have a width of approximately 0.0390 mm (39 μm), and so forth. Preferably, each subsequent LED element continues diminishing in size at an equal rate (for example, at a 0.5 μm increment) to create the micro-scaled reticle pattern 225. For instance, in the described embodiment, each subsequent LED element 200 in the vertical column 195 may continue decreasing in size by approximately 0.005 mm (0.5 μm) until reaching a predetermined or desired minimum size, such as 0.014 mm (14 μm) for the LED element 204. In other embodiments, the minimum size may be (20 μm). In some embodiments, the lower end 197 of the vertical column 195 may comprise of uniformly sized LED elements having the same size as the smallest desired LED element 204 (e.g., all the LED elements below LED element 204 in the vertical column 195 may be the same 14 μm size). In other embodiments, the LED elements 200 may continue diminishing at an equal rate until the end of the vertical column 195.

In some embodiments, the pixel pitch of the LED elements 200 in the vertical column 195 may be approximately the same size or larger than the pixel size of the largest LED element 201. For instance, in one embodiment, the LED elements 200 may have a pixel pitch of 0.05 mm (50 μm). Preferably, the pixel pitch of the LED elements 200 is sufficiently small in comparison to the pixel size of the LED elements 200 such that a gap or spacing between the aiming points is not visually perceptible.

It should be understood that the values provided above for the LED elements 200 in the reticle pattern 225 are for illustration purposes and not intended to be limiting. In other embodiments, the LED elements 200 may have different pixel sizes and pixel pitches than the values provided above. Preferably, the pixel sizes and pixel pitches are selected to create a reticle pattern 225 with individual aiming points that diminish in size at a substantially constant rate from a top end of the reticle pattern 225 toward a bottom end. For instance, in some embodiments, the LED elements 200 may decrease in pixel size at a rate of approximately 2% (e.g., the LED element 202 is approximately 2% smaller in pixel size than the LED element 201). In other embodiments, the LED elements 200 may decrease in pixel size at a rate of up to 5%.

In some embodiments, the reticle pattern 225 may be formed by an LED array comprising a single column of LED elements 200. In such embodiments, the controller 80 or other system may simply illuminate the entire LED array to form the reticle pattern 225. In other embodiments, the controller 80 or other operating system may run firmware or software to calculate the reticle pattern 225 in a similar fashion to the embodiment described with reference to FIG. 4. For instance, a starting coordinate pair (x, y) may be determined from a large grid array of LED elements similar to LED grid array 175 of FIG. 4. From the starting coordinate pair (x, y), the reticle pattern 225 may be created by illuminating the LED elements 200 having the coordinates: x, y+1; x, y+2; x, y+3, and so on to create the upper portion of the post pattern. The bottom portion of the post may be created by illuminating LED elements 200 having the coordinates: x, y−1; x, y−2; x, y−3, and so on.

With general reference to FIGS. 4, 5, and 7, the following section briefly describes an example embodiment for powering/controlling the LED elements in the LED arrays. In one embodiment, the LED elements in the LED array may be selectively powered using a passive matrix addressing scheme. In a passive matrix addressing scheme, the LED elements (or pixels) are arranged in a variety of rows and columns (see for example, LED array 175 of FIG. 4) connected to an integrated circuit. The integrated circuit controls when a current is sent down a particular row or column to activate the individual pixels in the LED array located at the intersection point of the activated row and column. For instance, with reference to the grid array 175 of FIG. 4, an LED element 190 having an address (column H, row 9) may be activated by sending current to column H and row 9. Similarly, other LED elements in the reticle pattern 185 may be activated by sending current to the particular column and row address of the pixel. Once all desired elements have been powered, the resulting reticle pattern 185 is generated on the LED array and is viewable by the user. Once the LED elements are activated, the LED elements maintain their state (e.g., activated or not activated) until a subsequent control signal from the integrated circuit to refresh the rows/columns of pixels. Depending on the control signal, the same pattern of rows/columns of pixels may be used (e.g., to display the same reticle pattern) or a different group of pixels may be activated (e.g., to display a different reticle pattern). In some embodiments, the LED elements may be controlled to project continuous pulsed and/or modulated light patterns for the reticles or other visual displays as desired.

In other embodiments, the LED elements may be powered using a direct addressing scheme. In such embodiments, each pixel in the LED array is equipped with its own circuit. To power/control the LED elements, a microprocessor or other system applies a voltage to each element separately, thereby individually activating the LED elements as desired. Because each pixel is controlled independently and requires its own circuitry, direct addressing may be best suited for displays that have only a few LED elements. For instance, in some embodiments, one or both of the numerical display portion 260 and the character display portion 265 of the micro-pixelated display 250 (see FIG. 7), may be powered using a direct addressing scheme.

In other embodiments, a flip-chip bonding method may be used to bond the micro-LED array and corresponding circuitry as an alternative to the wire bonding process described above. For instance, in one embodiment, the micro-LED array (e.g., array 150, 175) may be formed on a front surface of a sapphire substrate and mounted onto a silicon CMOS driver chip using the flip-chip technique with indium bump bonding. In such embodiments, light generated in the micro-LED elements is emitted from the polished back surface of the sapphire substrate opposite the front surface to display images or patterns generated by the microLED array. The micro-LEDs share a common anode (n-type contact) and each micro-LED element has its own independently controllable cathode (p-type contact). The signal connections between the CMOS driver chip and the micro-LED array are accomplished in a single flip-chip bonding package through the indium metal bumps, thereby eliminating the need for wire bonding. In an alternate embodiment (not shown), the flip-chip package configuration may allow a microLED array of the kind illustrated in FIG. 4 to be driven by a passive or active matrix addressing scheme by equipping each micro-LED with its own pixel driver circuit that is capable of driving the individual micro-LED.

It should be understood that although some reticle patterns are described above with reference to a particular optical device (e.g., a riflescope 5 or a reflex sight 90), the embodiments described herein may be combined in various ways. For instance, as mentioned previously, the simple reticle patterns 160, 165, 170 illustrated in FIG. 3 may be better suited for use with the reflex sight 90 because of its size constraints and lack of need for a transparent display. However, in some embodiments, a more complex reticle pattern (e.g., reticle pattern 225 of FIGS. 5-8), may be adapted for use with the reflex sight 90. For instance, in some embodiments, a portion of the vertical column 195 of reticle pattern 225 may be used to provide a reticle for the reflex sight 90 with holdover data for a limited range (as compared to a riflescope). In other embodiments, a smaller scaled version (e.g., using smaller sized LED elements) of the vertical column 195 of the reticle pattern 225 may be used. In some embodiments, the microLED elements may be arranged in an array as large as 6 mm×6 mm to generate a reticle pattern of appropriate scale to satisfy the size constraints of a typical reflex sight.

Figure 9:
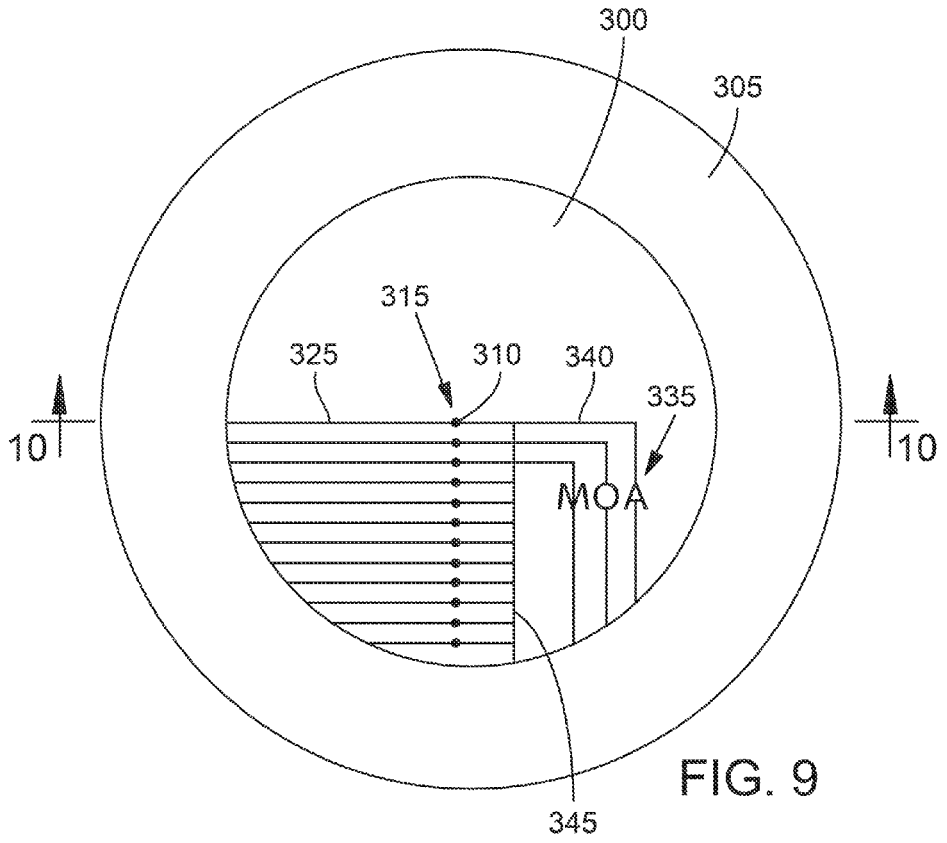
FIG. 9 is a top plan view of one embodiment of a transparent reticle according to the present disclosure.
Figure 10:
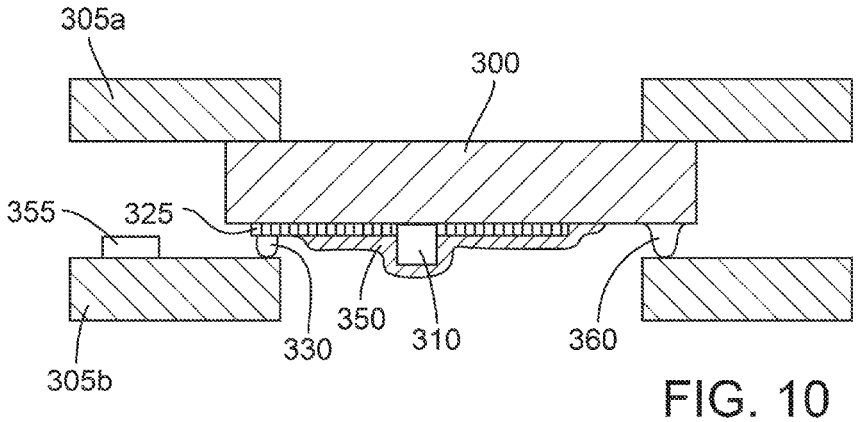
FIG. 10 is a cross-section view of the transparent reticle of FIG. 9 taken along line 10-10 of FIG. 9.

FIG. 9 is a rear schematic view of an example reticle display, as viewed from an eyepiece side, including a sapphire substrate 300 supported on a ring carrier 305 according to one embodiment. FIG. 10 is a schematic cross-section view (not to scale) taken along line 10-10 of FIG. 9. With reference to FIGS. 9-10, the sapphire substrate 300 carries a plurality of micro-LEDs 310, which may be arranged in a micro-LED array (not shown), and which are operable to illuminate a reticle pattern 315. The sapphire substrate 300 also supports a plurality of electrical traces 325 connected to the micro-LEDs 310, the traces 325 radiating from the micro-LEDs 310 to the perimeter of the sapphire substrate 300 where they connect to solder pads on the sapphire substrate 300. The solder pads (not illustrated) are electrically coupled via conductive solder bumps 330 (or other conductive adhesive or bonds) to a driver circuit (not shown) that is preferably integrated with or carried by ring carrier 305.

Some of the traces 325 connect to a common ground 345 that also radiates to the perimeter of the sapphire substrate 300. In some embodiments, the sapphire substrate 300 further supports a micro-LED array that forms a micro-pixelated display 335 (similar to the micro-pixelated display 250 described in FIG. 7). The micro-pixelated display 335 may also include a plurality of traces 340 connected to a common ground 345. Preferably, the traces 325, 340 are made of thin films of a transparent or nearly transparent materials, such as indium tin oxide (ITO), aluminum, gallium, or indium doped zinc-oxide (AZO, GZO or IZO) or graphene so that the traces 325, 340 are not visually perceptible on the reticle. With reference to FIG. 10, a protective barrier layer 350 may be deposited over the micro-LEDs 310 and the traces, 325, 340 on the sapphire substrate 300 to protect these components and prevent degradation, damage, or failure.

Continuing with reference to FIG. 10, ring carrier 305 may include a rear retainer ring **305*a* proximal the eyepiece side of the reticle assembly and a front coupling ring 305*b* on the objective side of the reticle assembly, and the sapphire substrate 300 may be supported along its perimeter and clamped between the two rings 305*a*, 305*b*. Rings 305*a*, 305*b* may include mechanical locating features (not illustrated) to accurately center the sapphire substrate relative to the outder diameter or other locating surfaces of the rings 305*a*, 305*b***. In other embodiments, accurate location and mechanical zeroing of a micro-pixellated reticle is rendered unnecessary by the ability to sight-in the reticle and electronically adjust the zero-point or sighted-in primary aiming point.

Preferably, when the sapphire substrate 300 and ring carrier 305 are assembled and mounted within the riflescope 5 (or reflex sight 90), the sapphire substrate 300 is attached to a rear-facing surface of ring carrier 305 (proximal of the eyepiece 40). For example, as illustrated in FIG. 10, a forward-facing surface of sapphire substrate 300 is preferably electrically coupled to a rear face of the front coupling ring **305*b* via solder bumps 330. Coupling ring 305*b* is preferably a CMOS circuit or printed circuit board that serves as the electrical controller for the reticle display formed on the sapphire substrate 300. The rear-mounted arrangement described above helps prevent detachment of the sapphire substrate 300 from the ring carrier 305 when the sighting device is subjected to weapon recoil forces by imparting compressive forces on the solder bumps 330 (or other electrically conductive connection) during recoil instead of tensile forces; it being recognized that the electrical connections are stronger in compression than in tension. In some embodiments, a high-strength and preferably nonconductive adhesive material 360 may be used to securely bond together the sapphire substrate 300 and the circuit substrate 305 (including the retainer ring 305*a*, coupling ring 305*b*, or both) at locations where there are no electrical traces or pads. The adhesive material 360 may be used in addition to the electrical connections of solder bumps 330, or other conductive connections, to further improve the durability of the electrical connection between the sapphire reticle substrate 300 and the coupling ring 305***b*. The coupling ring 305*b* may be a printed circuit board (PCB), or a silicon wafer, or another patterned integrated circuit. Preferably, the rings 305*a* and 305*b* of ring carrier 305 have a circular central opening and a circular outer diameter that is dimensioned to fit within the tubular housing of the riflescope 5. The ring carrier 305, and especially the coupling ring 305*b*, may support a controller 355 that may be interconnected with circuits patterned on one or both of the rings 305*a*, 305*b*. The controller 355 may be coupled to the rings 305*a* or 305*b* using a wire-bonding process and encased in a protective package (similar to the package 205 described above with reference to FIG. 5). In other embodiments, the controller may be formed directly on a silicon coupling ring 305*b* via a semiconductor integrated circuit manufacturing process, in which case the entire ring may be protected by a package.

In some embodiments, the entire ring carrier and any electrical circuitry supported thereon may be encased in a protective package of the kind described above with reference to FIG. 5, while leaving the transparent central region of the assembly spanned by sapphire substrate free of package material.

In some embodiments, the controller 355 may be a simple system that controls basic operations of the micro-LEDs 310, such as power, to minimize wiring or traces on the glass substrate 305. In such configurations, the controller 355 may be connected via a flex circuit or cable to a remote processor or other control system (not shown) located elsewhere within the sighting device (e.g., not carried or supported on the circuit substrate 305) and capable of handling more robust operations, such as interface ballistics calculations, and matrix addressing protocols.

It will be obvious to those having skill in the art that many changes may be made to the details of the above-described embodiments without departing from the underlying principles of the invention.

The invention claimed is:

1. A sighting device comprising:

an optical viewing element having a field of view therethrough;

a display device including an addressable, emissive array of display elements for generating an aiming mark viewable via the optical viewing element, the aiming mark superimposed on the field of view, wherein each of the display elements has a pixel size of 25 μm or less, and wherein the display elements of the array are arranged at a pixel pitch of 30 μm or less; and a controller coupled to the display device, the controller configured to selectively power one or more of the display elements to generate the aiming mark.

2. The sighting device of claim 1, further comprising a housing supporting the optical viewing element, the housing mountable to a projectile weapon to align the sighting device therewith, wherein the optical viewing element is arranged in a generally upright position.

3. The sighting device of claim 1, wherein the controller is further in communication with an input device, the controller receiving ranging information to the distant object via the input device, and wherein the controller selectively powers one or more of the display elements to generate the aiming mark based on the ranging information.

4. The sighting device of claim 3, wherein the input device comprises a rangefinder.

5. The sighting device of claim 1, wherein the array is a two-dimensional array and the display elements comprise inorganic LED elements.

6. The sighting device of claim 5, wherein the controller is further configured to generate the aiming mark by:

determining a starting coordinate on the two-dimensional array corresponding to a first LED element;

determining an address of one or more additional LED elements; and powering the first and the one or more additional LED elements.

7. The optical aiming device of claim 1, wherein the controller is further in communication with an input device, the controller receiving ranging information to the distant object via the input device, and wherein the controller selectively powers one or more of the display elements to generate the aiming mark based on the ranging information.

8. The optical aiming device of claim 7, wherein the input device comprises a rangefinder.

9. An optical aiming device mountable to a projectile weapon, the optical aiming device comprising:

an objective that produces an image of a distant object;

an eyepiece for viewing a field of view including the image of the distant object;

a transparent display device including a collection of addressable, emissive display elements supported on a transparent substrate positioned proximate a focal plane of the optical aiming device, the aiming mark viewable through the eyepiece and superimposed on the image of the distant object, wherein each of the display elements in the collection has a pixel size of 25 μm or less, and wherein the display elements are arranged at a pixel pitch of 30 μm or less;

a controller coupled to the display device, the controller configured to selectively power one or more of the display elements to generate the aiming mark; and a housing supporting the objective, the eyepiece, the display device, and the controller, the housing including a mount for mounting the optical aiming device to the projectile weapon.

10. The optical aiming device of claim 9, wherein the collection of display elements is arranged in a vertical column, the vertical column including a plurality of display elements beginning with a first display element proximate a center of the display device and a series subsequent display elements spaced apart below the first display element in the field of view, each of the subsequent display elements smaller than the adjacent display element located above said subsequent display element in the field of view.

11. The optical aiming device of claim 10, wherein each of the display elements corresponds to an individual hold-over aiming point, and wherein the controller is further configured to selectively power one of the display elements based on a distance to the distant object.

12. The optical aiming device of claim 9, wherein a first subset of display elements of the collection of display elements is arranged for generating a numerical display viewable through the eyepiece, the numerical display including a plurality of leg segments, wherein each leg segment has a width of 20 μm or less and is spaced apart from an adjacent leg segment by 10 μm or less.

13. The optical aiming device of claim 12, wherein a second subset of display elements of the collection of display elements is arranged for generating an alphabetic character display viewable through the eyepiece, the character display including one or more character elements having a height of 20 μm or less.

14. The optical aiming device of claim 9, wherein the collection of display elements is a two-dimensional array, and the display elements comprise inorganic LED elements.

15. The optical aiming device of claim 9, wherein the controller is further configured to generate the aiming mark by:

determining a starting coordinate on the two-dimensional array corresponding to a first LED element;

determining an address of one or more additional LED elements; and powering the first and the one or more additional LED elements.

16. The optical aiming device of claim 9, wherein the controller is further configured to control a color output and an intensity output of at least some of the display elements.

* * * * *